US009989025B2

(12) United States Patent
Tani

(10) Patent No.: US 9,989,025 B2
(45) Date of Patent: Jun. 5, 2018

(54) INJECTOR ASSEMBLY

(71) Applicant: HONDA MOTOR CO., LTD., Tokyo (JP)

(72) Inventor: Yusaburo Tani, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 222 days.

(21) Appl. No.: 14/844,171

(22) Filed: Sep. 3, 2015

(65) Prior Publication Data

US 2016/0090953 A1 Mar. 31, 2016

(30) Foreign Application Priority Data

Sep. 30, 2014 (JP) ..... 2014-200914

(51) Int. Cl.

| | |
|---|---|
| ***F02M 55/00*** | (2006.01) |
| ***F02M 51/00*** | (2006.01) |
| ***F02M 61/14*** | (2006.01) |
| ***F02M 61/16*** | (2006.01) |
| ***F02M 69/46*** | (2006.01) |

(52) U.S. Cl.

CPC ..... *F02M 55/004* (2013.01); *F02M 51/005* (2013.01); *F02M 61/14* (2013.01); *F02M 61/168* (2013.01); *F02M 69/462* (2013.01); *F02M 2200/851* (2013.01); *F02M 2200/852* (2013.01); *F02M 2200/855* (2013.01)

(58) Field of Classification Search

CPC .... F02M 55/004; F02M 51/005; F02M 61/14; F02M 61/168; F02M 69/462; F02M 2200/851; F02M 2200/852; F02M 2200/855

USPC ..... 123/469, 471, 477, 468, 470, 461; 29/888.46, 890.02, 890.1, 890.124; 239/533.6, 585.3, 585.4, 585.5, 600

See application file for complete search history.

(56) References Cited

U.S. PATENT DOCUMENTS 4,403,586 A * 9/1983 Taniguchi ..... F02M 39/00 123/468
4,570,602 A * 2/1986 Atkins ..... F02M 55/004 123/456
5,095,876 A * 3/1992 Yonekawa ..... F02M 69/465 123/41.31
5,172,671 A * 12/1992 Peters ..... F02B 77/13 123/456

(Continued)

FOREIGN PATENT DOCUMENTS

EP 0 161 693 B1 3/1988
EP 1 862 667 B1 7/2013

(Continued)

*Primary Examiner* — Thomas Moulis
*Assistant Examiner* — John Bailey
(74) *Attorney, Agent, or Firm* — Squire Patton Boggs (US) LLP

(57) ABSTRACT

A distal end portion of an injector is fitted into a mounting member. A fuel joint having a connecting pipe portion is connected to a proximal portion of the injector. A joint pressing member which restricts the displacement of the fuel joint in the direction away from the mounting member is fixed by fastening to the mounting member. The injector is fixed to the mounting member by restricting the displacement of the fuel joint by the joint pressing member.

13 Claims, 13 Drawing Sheets

(56) References Cited

U.S. PATENT DOCUMENTS 5,501,195 A * 3/1996 Hall ..... F02M 61/145 123/470
5,657,733 A * 8/1997 Dozier ..... F02M 35/10216 123/456
5,718,206 A * 2/1998 Sawada ..... F02M 51/005 123/456
5,870,995 A * 2/1999 Stockner ..... F02M 61/14 123/456
5,893,351 A * 4/1999 Akutagawa ..... F02M 51/005 123/456
6,178,950 B1 * 1/2001 Stockner ..... F02M 55/025 123/469
6,223,727 B1 * 5/2001 Tahara ..... F02M 51/0671 123/470
6,314,943 B1 * 11/2001 Burch ..... F02M 61/14 123/456
6,338,333 B1 * 1/2002 Brosseau ..... F02M 35/10085 123/456
6,341,595 B1 * 1/2002 Scollard ..... F02M 55/004 123/456
7,347,190 B1 * 3/2008 Keegan ..... F02M 55/02 123/456
7,406,946 B1 * 8/2008 Watanabe ..... F02M 55/005 123/456
7,527,038 B2 * 5/2009 Watanabe ..... F02M 55/02 123/470
2002/0148446 A1 * 10/2002 Gmelin ..... F02M 61/14 123/470
2002/0152995 A1 * 10/2002 Kato ..... F02B 61/045 123/470
2002/0157648 A1 * 10/2002 Reiter ..... F02M 61/14 123/470
2003/0101969 A1 * 6/2003 Baessler ..... F02M 55/025 123/468
2003/0154961 A1 * 8/2003 Liskow ..... F02M 69/465 123/470
2003/0172911 A1 * 9/2003 Nishiwaki ..... F02M 61/14 123/456
2004/0194764 A1 * 10/2004 Okajima ..... F02M 61/14 123/469
2005/0028790 A1 * 2/2005 Ikeda ..... B62J 37/00 123/470
2005/0229902 A1 * 10/2005 Taguchi ..... F02D 9/1095 123/336
2005/0257774 A1 * 11/2005 Usui ..... F02M 55/025 123/456
2006/0157021 A1 * 7/2006 Nakagawa ..... F02D 9/1035 123/336
2006/0288986 A1 * 12/2006 Liskow ..... F02M 55/025 123/469
2008/0216798 A1 * 9/2008 Ghelardi ..... F02M 55/005 123/470
2009/0031992 A1 * 2/2009 Lysinger ..... F02M 55/02 123/470
2009/0056674 A1 * 3/2009 Furst ..... F02M 61/14 123/470
2010/0012093 A1 * 1/2010 Pepperine ..... F02M 55/004 123/470
2010/0024746 A1 * 2/2010 Merchant ..... F01P 3/16 123/41.42
2010/0170477 A1 * 7/2010 Biasci ..... F02M 55/005 123/470
2010/0186717 A1 * 7/2010 Scheffel ..... F02M 61/14 123/470
2010/0218743 A1 * 9/2010 Marc ..... F02M 55/025 123/470
2010/0258085 A1 * 10/2010 Giorgetti ..... F02M 55/02 123/470
2010/0313851 A1 * 12/2010 Di Domizio ..... F02M 55/004 123/470
2011/0030656 A1 * 2/2011 Pepperine ..... F02M 61/14 123/470
2011/0186016 A1 * 8/2011 Bolz ..... F02M 55/004 123/470
2012/0017875 A1 * 1/2012 Ishiki ..... F02M 55/02 123/468
2012/0204837 A1 * 8/2012 Harvey ..... F02M 61/14 123/469
2012/0247426 A1 * 10/2012 Roseborsky ..... F02M 61/14 123/470
2013/0192565 A1 * 8/2013 Roseborsky ..... F02M 61/14 123/470
2014/0041636 A1 * 2/2014 Di Domizio ..... F02M 61/14 123/470
2014/0123951 A1 5/2014 Imakita et al.

FOREIGN PATENT DOCUMENTS

GB 2 023 729 B 12/1982
JP 2004-183538 A 7/2004

* cited by examiner

INJECTOR ASSEMBLY

BACKGROUND

Field

The present invention relates to an injector which injects fuel to be supplied to an engine, and an injector assembly having a fuel joint for connecting a fuel hose to the injector.

Description of the Related Art

As an engine used for a vehicle such as a motorcycle, there has been known an engine where fuel is injected into the engine by an injector supported on a throttle body, an intake pipe, a cylinder head or the like.

In an injector used for this type of engine, a distal end portion of the injector is fitted into a mounting member of a throttle body or the like, and a fuel joint for taking in fuel is liquid-tightly connected to a proximal portion side of the injector. The fuel joint includes a fitting connecting portion which is fitted on the proximal portion side of the injector, and a connecting pipe portion for connecting a fuel hose to the fuel joint.

As an injector assembly having the above-mentioned injector and the fuel joint, there has been known an injector assembly where a fuel joint is fastened to a mounting member using bolts in such a manner that an injector is sandwiched between the fuel joint and the mounting member (for example, see Japanese Patent Publication JP-A-2004-183538 (Patent Literature 1)).

In the injector assembly disclosed in Patent Literature 1, a boss portion for fastening the injector assembly to the mounting member using bolts is integrally formed on the fuel joint besides a fitting connecting portion fitted into a proximal portion side of the injector and a connecting pipe portion for connecting a fuel hose to the fuel joint. The injector assembly is configured such that a distal end portion of the injector is fitted into a fitting hole formed in the mounting member in a state where the fuel joint is assembled to the proximal portion side of the injector in advance, and the boss portion of the fuel joint in such a state is fastened to the mounting member using bolts.

However, in the above-mentioned conventional injector assembly, the connecting pipe portion and the boss portion are integrally formed with the fuel joint and hence, the position of the boss portion fastened to the mounting member and the projecting direction of the connecting pipe portion to which the fuel hose is connected are decided univocally. Accordingly, in adopting the above-mentioned conventional injector assembly, a drawing angle of the fuel hose from the mounting member is univocally decided and hence, it is difficult to use such an injector assembly in common by vehicles having different specifications.

SUMMARY

In view of the above, it is an object of the invention to provide an injector assembly which can be easily used in common by vehicles having different specifications.

To achieve the above-mentioned object, an injector assembly according to embodiments of the invention include an injector which has a distal end portion thereof fitted into a mounting member and injects fuel to be supplied to an engine. A fuel joint has a connecting pipe portion to which a fuel hose is connected, and is liquid-tightly connected to a proximal portion of the injector. The injector is fixed to the mounting member in a state where the injector is sandwiched between the fuel joint and the mounting member. The injector assembly further comprises a joint pressing member which is fixed by fastening to the mounting member and restricts the displacement of the fuel joint in the direction away from the mounting member.

Due to such a constitution, the displacement of the fuel joint in the direction away from the mounting member is restricted by the joint pressing member which is a part separate from the fuel joint. A projecting direction of the connecting pipe portion of the fuel joint is changeable by changing a relative angle of the fuel joint with respect to the joint pressing member.

The fuel joint can include a joint-side engagement flange which is disposed closer to the injector than the connecting pipe portion. The displacement of the joint-side engagement flange in the direction away from the injector is restricted by the joint pressing member.

In this case, the displacement of the fuel joint in the direction away from the injector is restricted by the joint pressing member at the joint-side engagement flange portion closer to the injector than the connecting pipe portion. Accordingly, the fuel joint does not largely project in the direction away from the injector compared to the connecting pipe portion and hence, the fuel joint can be miniaturized. Further, the joint pressing member can be also miniaturized.

An assembling angle positioning mechanism, capable of performing positioning of the fuel joint and the joint pressing member by selectively changing an assembling angle between the fuel joint and the joint pressing member may be provided between the fuel joint and the joint pressing member. The assembling angle positioning mechanism can include one fitting element and another fitting element which are engageable with each other by male-female fitting engagement. The one fitting element may be constituted of a plurality of fitting elements formed on the fuel joint with angles thereof changed in the circumferential direction. The other fitting element may be constituted of at least one fitting element formed on the joint pressing member. In this case, a relative angle of the joint pressing member with respect to the fuel joint can be easily changed by changing the combination of fitting engagement between one fitting element and the other fitting element of the assembling angle positioning mechanism.

The fuel joint can include a joint-side engagement flange whose displacement in the direction away from the injector is restricted by the joint pressing member. The injector can include an injector-side engagement flange whose displacement in the direction away from the fuel joint is restricted by the joint pressing member. The joint pressing member can include a clamping portion which, in a state where the fuel joint is connected to the proximal portion of the injector, is inserted into both the fuel joint and the injector from sides of the fuel joint and the injector and clamps the joint-side engagement flange and the injector-side engagement flange. In this case, when the clamping portion of the joint pressing member is inserted into the connecting portion between the fuel joint and the injector from the sides of the fuel joint and the injector, the joint-side engagement flange and the injector-side engagement flange are clamped by the clamping portion of the joint pressing member. As a result, a connection state between the fuel joint and the injector is maintained.

The clamping portion can be arranged at left and right sides so as to sandwich the fuel joint and the proximal portion of the injector. In this case, the clamping portion of the joint pressing member clamps the joint-side engagement flange and the injector-side engagement flange on both left and right sides of the fuel joint and the proximal portion of the injector. As a result, a connection state of the fuel joint and the injector can be stably maintained.

A connector which is an electric connection portion of a fuel injection portion can be formed on a side of the injector. The clamping portion of the joint pressing member may be inserted into the fuel joint and the injector from the direction opposite to a side where the connector is arranged. In this case, the clamping portion of the joint pressing member is assembled to the fuel joint and the injector without interfering with the connector.

According to certain embodiments of the invention, the joint pressing member which is a part separate from the fuel joint is provided, the joint pressing member is fixed by fastening to the mounting member, and the removal of the fuel joint from the mounting member is restricted by the joint pressing member. Accordingly, when vehicles differ from each other in a drawing angle of the fuel hose from the mounting member, the same injector assembly can be easily used in common by those vehicles by changing an angle of assembling the joint pressing member to the fuel joint.

DETAILED DESCRIPTION

Hereinafter, certain embodiments of the invention are explained by reference to drawings. An injector assembly 1 is mounted on an intake system of an engine of a saddle-ride-type vehicle such as a motorcycle.

Figure 1:
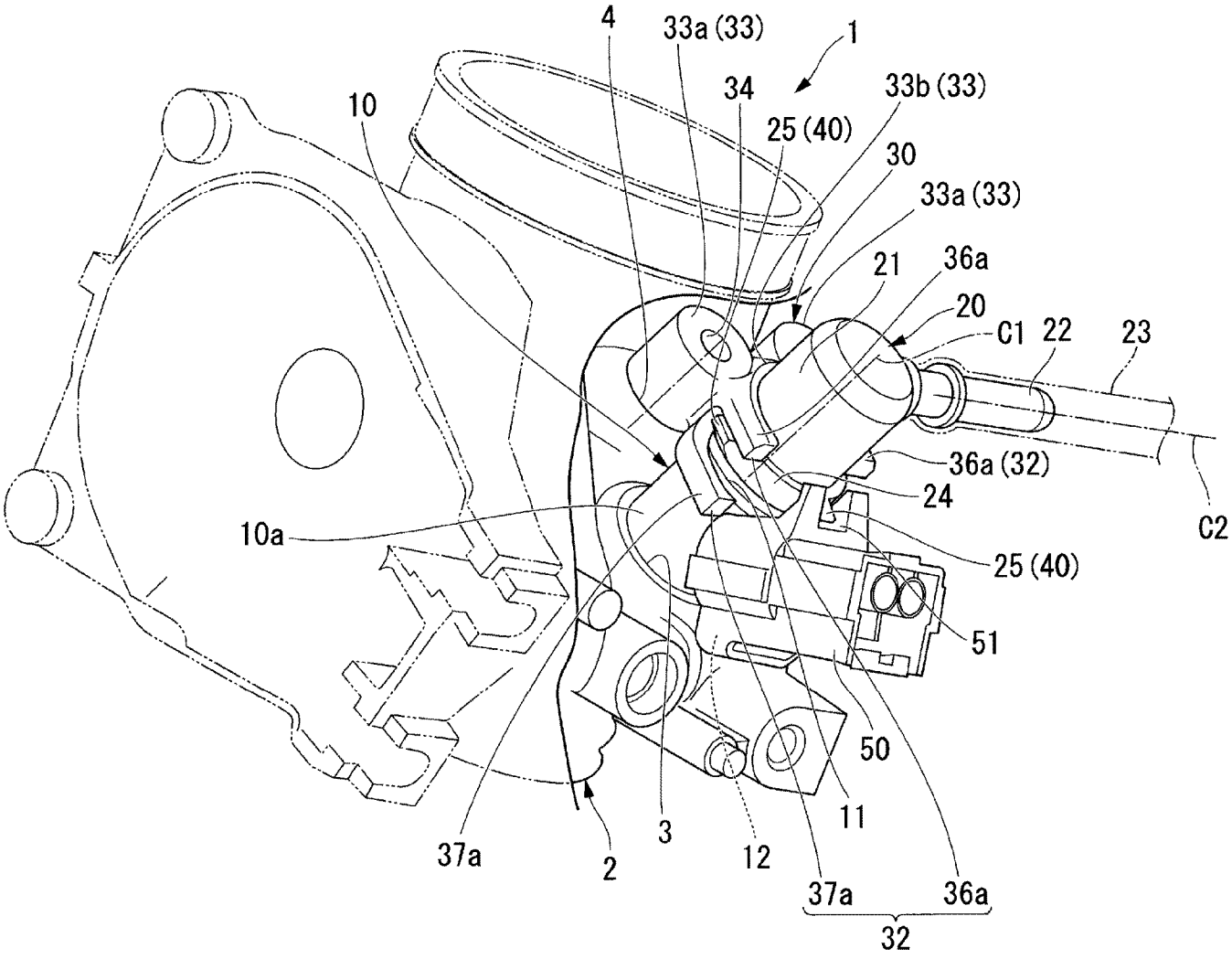
FIG. 1 is a perspective view showing a mounting portion of an injector assembly according to certain embodiments of the invention.
Figure 2:
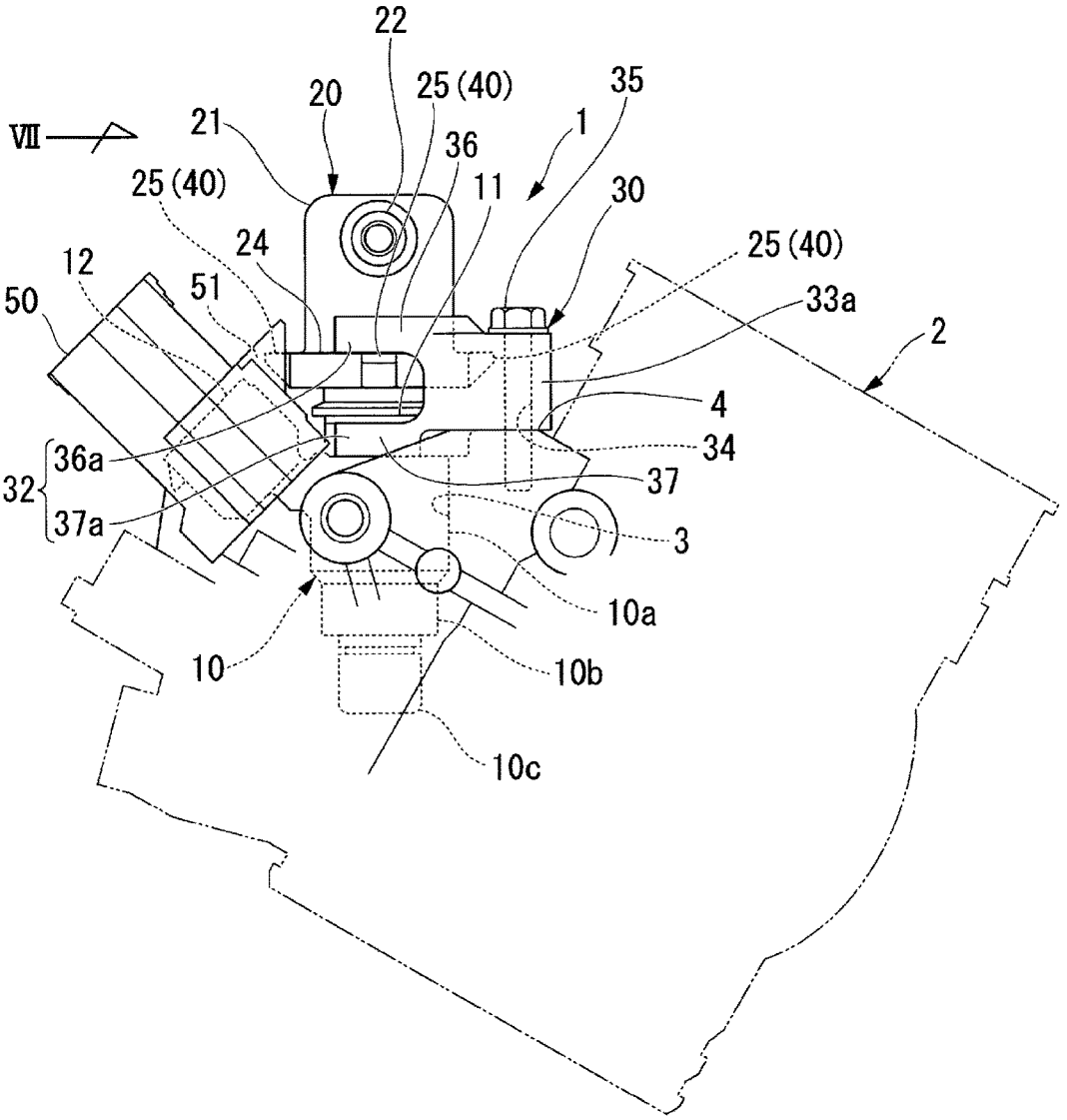
FIG. 2 is a view of the mounting portion of the injector assembly according to certain embodiments of the invention as viewed in an axial direction of a connecting pipe portion.

FIG. 1 and FIG. 2 are views showing a state where the injector assembly 1 is mounted on a throttle body 2 which is one form of a mounting member. The mounting member on which the injector assembly 1 is mounted is not limited to the throttle body 2 and may be other members in an intake system such as an intake pipe, a cylinder head of an engine or an air cleaner case.

The injector assembly 1 includes an injector 10 which has a distal end portion having a fuel injection portion (a fitting cylindrical portion 10*b* and a nozzle portion 10*c* described later) fitted into the throttle body 2 and injects fuel to be supplied to an engine into the inside of the throttle body 2. A fuel joint 20 is liquid-tightly fitted on and connected to a proximal portion (a connecting cylindrical portion 10*d* described later) of the injector 10. A joint pressing member 30 restricts the displacement of the fuel joint 20 in the direction away from the throttle body 2.

A fitting hole 3 into which a distal end portion of the injector 10 is fitted is formed in the throttle body 2. The distal end portion (nozzle portion 10*c*) of the injector 10 inserted into the fitting hole 3 faces the inside of an intake air passage not shown in the drawing which is formed in the inside of the throttle body 2. A mounting seat 4 to which the joint pressing member 30 is fixed by fastening is formed on an outer surface of the throttle body 2 at a position close to the fitting hole 3.

Figure 3:
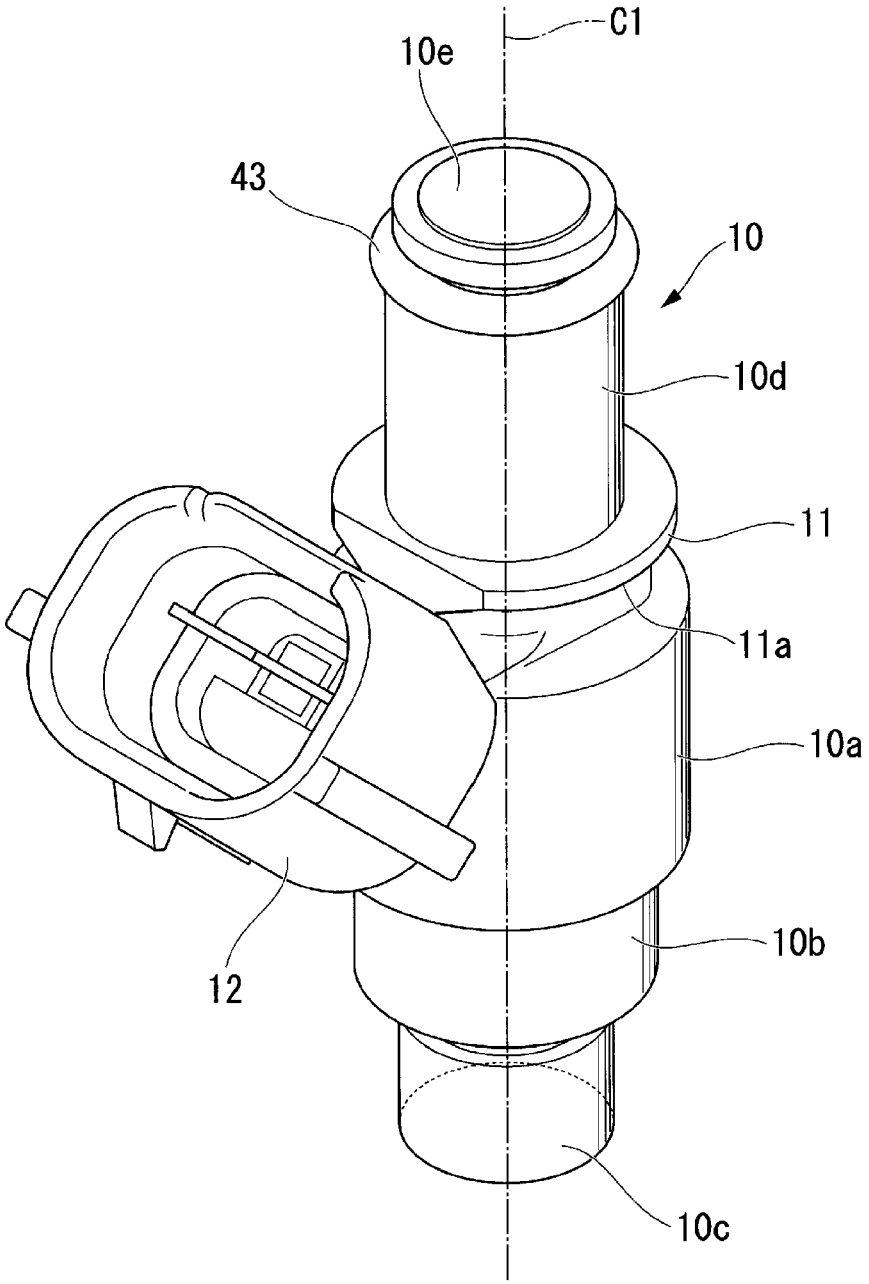
FIG. 3 is a perspective view of an injector according to certain embodiments of the invention.

FIG. 3 is a view showing the injector 10.

The injector 10 receives a control signal from a controller not shown in the drawing so that a fuel injection time and fuel injection timing are controlled. The injector 10 is configured such that a small-diameter fitting cylindrical portion 10*b* which is fitted into the fitting hole 3 is contiguously formed with one end side (a distal end side described on a lower side in FIG. 3) of a large-diameter portion 10*a* in which a solenoid for injection control not shown in the drawing is housed, and the nozzle portion 10*c* having a smaller diameter than the fitting cylindrical portion 10*b* is contiguously formed with a distal end portion of the fitting cylindrical portion 10*b*.

The small-diameter connecting cylindrical portion 10*d* which is connected to the fuel joint 20 is contiguously formed with the other end side (a proximal end side described on an upper side in FIG. 3) of the large diameter portion 10*a* of the injector 10. An injector-side engagement flange 11 which projects outwardly in the radial direction is integrally formed on the connecting cylindrical portion 10*d* at a position away from the large diameter portion 10*a* by a predetermined distance. A tapered surface 11*a* which is tapered toward a large diameter portion 10*a* side is formed on the injector-side engagement flange 11 on a side facing the large diameter portion 10*a*. An extending end of the connecting cylindrical portion 10*d* forms a fuel introducing portion 10*e* through which fuel is introduced into the injector 10 from a fuel joint 20 side.

Figure 4:
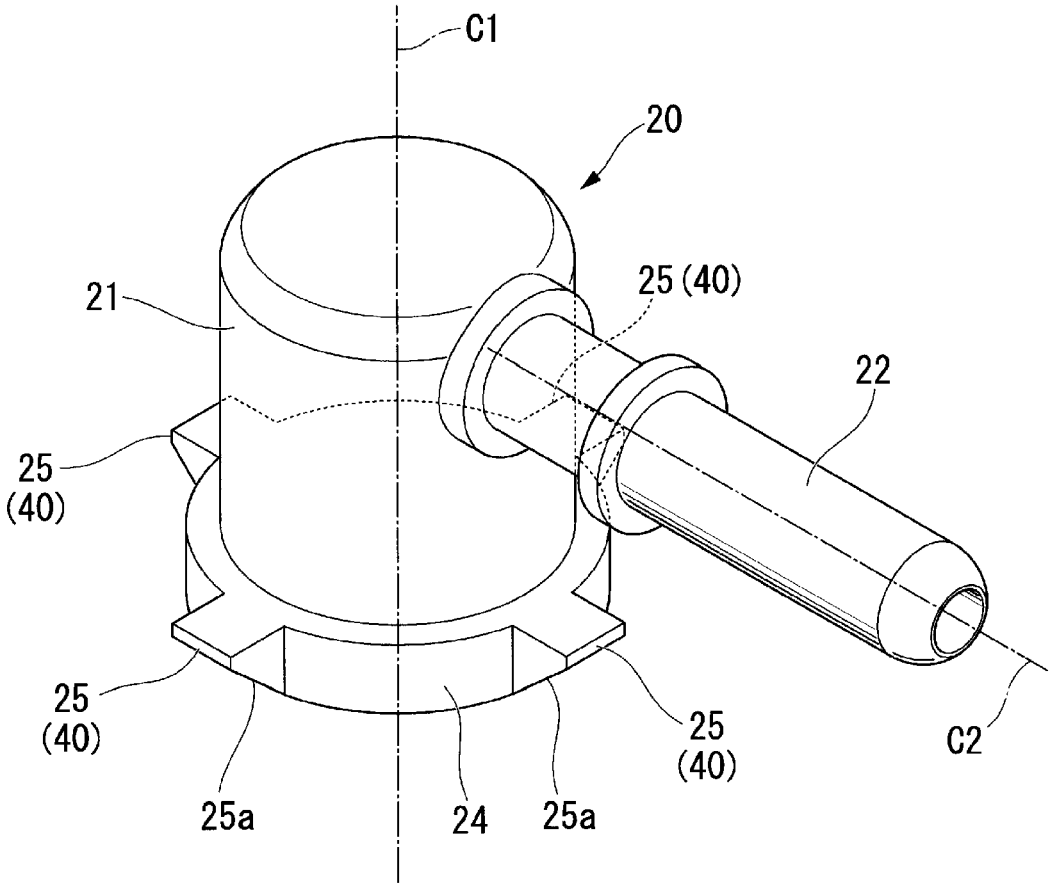
FIG. 4 is a perspective view of a fuel joint according to certain embodiments of the invention.
Figure 5:
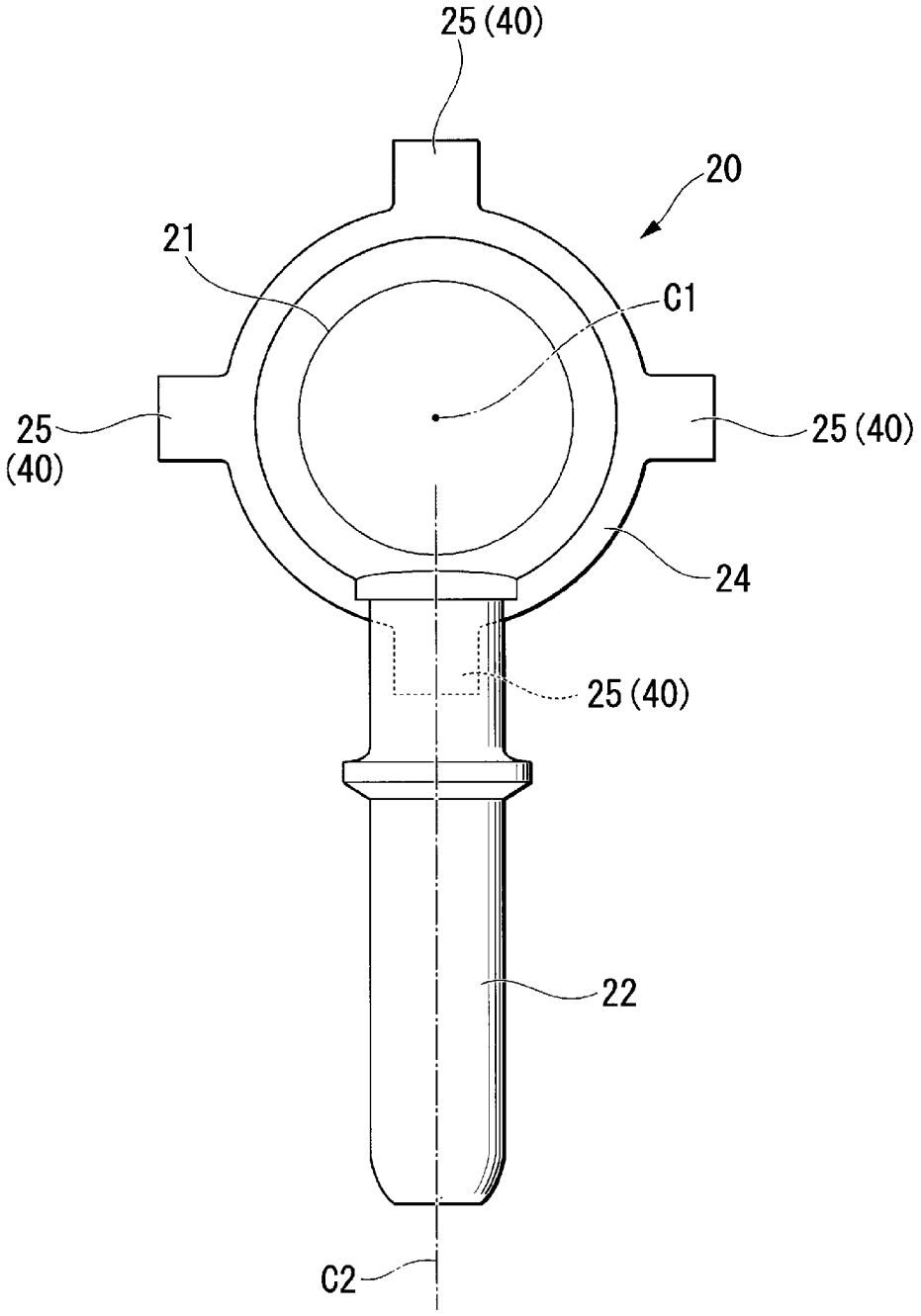
FIG. 5 is a plan view of the fuel joint according to certain embodiments of the invention.

Further, a connector 12 which is an electric connecting portion for supplying electricity to the solenoid for an injection control is formed in a projecting manner on an outer surface of the large diameter portion 10*a* of the injector 10 at a position close to the other end of the large diameter portion 10*a*. FIG. 4 and FIG. 5 are views showing the fuel joint 20.

The fuel joint 20 includes a bottomed cylindrical joint body portion 21, and the fitting cylindrical portion 10*b* of the injector 10 on a proximal portion side is fitted into and connected to joint body portion 21. A connecting pipe portion 22 is formed in a projecting manner on an outer surface of the joint body portion 21 at a position close to a bottom portion of the joint body portion 21. As shown in FIG. 1, a fuel hose 23 is connected to the connecting pipe portion 22. Fuel pressurized to a high pressure is introduced into the fuel hose 23 by operating a fuel pump not shown in the drawing. The fuel hose 23 connected to the connecting pipe portion is fixed to the connecting pipe portion 22 by a fastening band or a connector not shown in the drawing.

In the drawing, symbol C1 indicates an axis of the injector 10 and the joint body portion 21 of the fuel joint 20, and symbol C2 indicates an axis of the connecting pipe portion 22 of the fuel joint 20.

A joint-side engagement flange 24 which projects outwardly in the radial direction is integrally formed on an edge of a peripheral wall of the joint body portion 21 on a side opposite to a bottom portion of the peripheral wall. Four projections 25 are formed on an outer peripheral surface of the joint-side engagement flange 24 at intervals of 90° along the circumferential direction. The projection 25 is formed into an approximately square shape as viewed in the axial direction of the joint body portion 21. Further, a tapered surface 25*a* is formed on the projection 25 such that the projection 25 is tapered toward an end portion of the peripheral wall of the joint body portion 21 on an opening side.

Any one of four projections 25 of the fuel joint 20 is fitted into a fitting hole 31 formed in the joint pressing member 30 described in detail later. The projections 25 and the fitting hole 31 constitute an assembling angle positioning mechanism 40 of this embodiment. In this example, four projections 25 of the fuel joint 20 constitute one fitting element which is engageable by male-female fitting engagement, and the fitting hole 31 formed in the joint pressing member 30 constitutes the other fitting element which is engageable by male-female fitting engagement.

Figure 6:
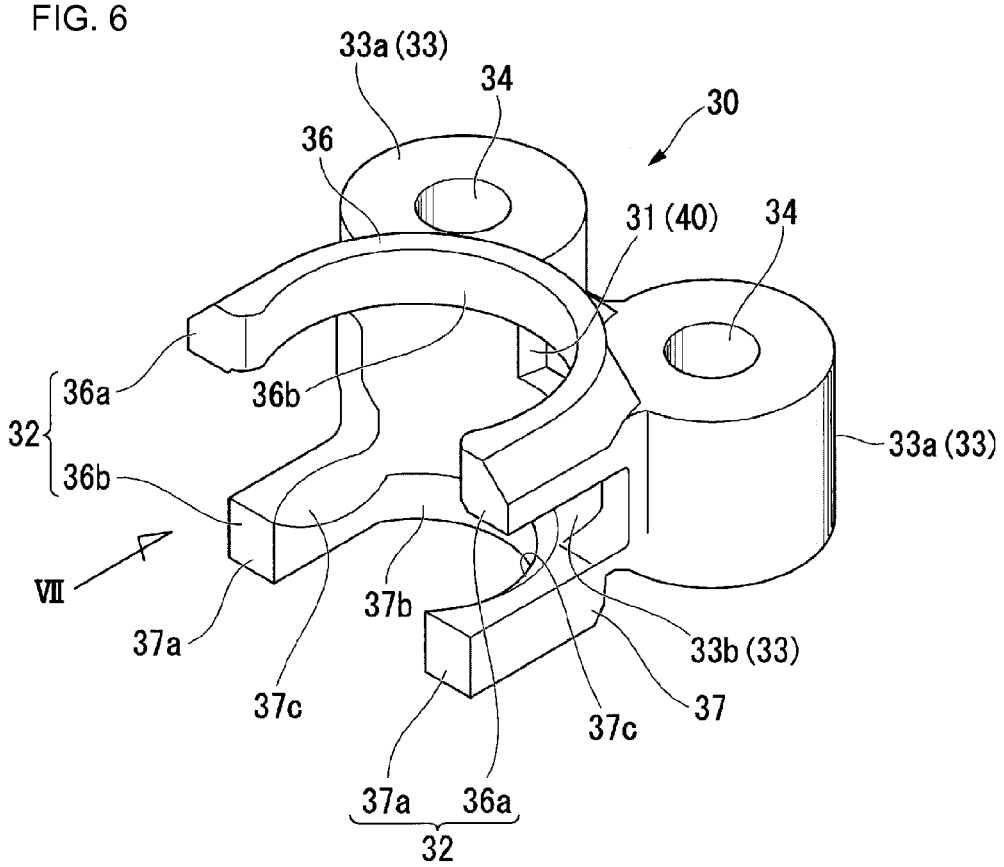
FIG. 6 is a perspective view of a joint pressing member according to certain embodiments of the invention.
Figure 7:
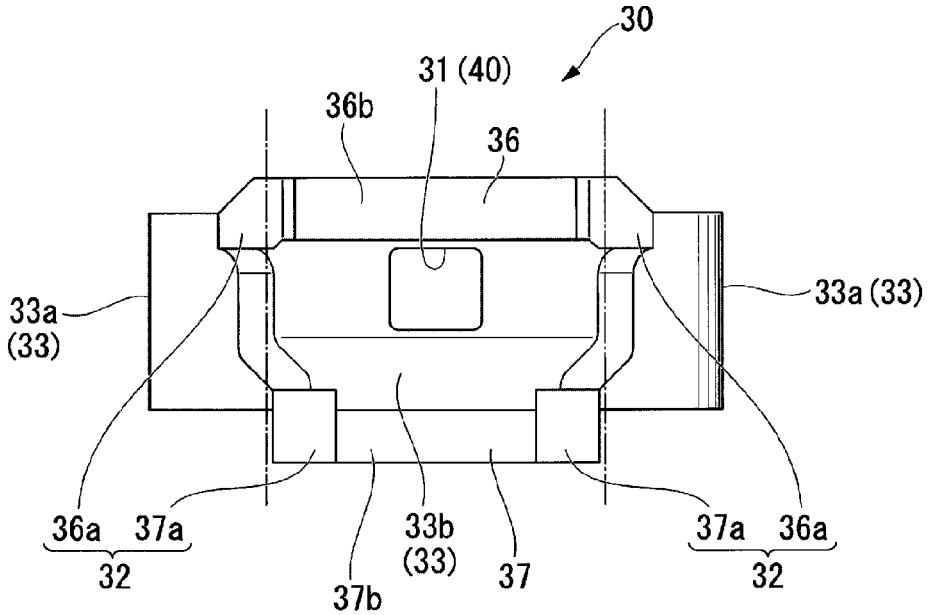
FIG. 7 is a view of the joint pressing member according to certain embodiments of the invention as viewed in the direction indicated by an arrow VII in FIG. 2.

FIG. 6 and FIG. 7 are views showing the joint pressing member 30.

The joint pressing member 30 includes a mounting proximal portion 33 having a pair of boss portions 33*a*, 33*a* which is fastened to the mounting seat 4 of the throttle body 2 using bolts. A pair of left and right clamping portions 32, 32 are formed on the mounting proximal portion 33 in an extending manner and makes the fuel joint 20 and the injector 10 which are connected to each other by fitting engage with each other.

The mounting proximal portion 33 includes an arcuate wall 33*b* having an approximately arcuate shape which covers a portion of the outer periphery of a connecting portion between the fuel joint 20 and the injector 10 in the circumferential direction. The above-mentioned boss portions 33*a*, 33*a* are mounted in a projecting manner on an outer surface of the arcuate wall 33*b* at two positions spaced apart from each other in the arcuate direction. The previously-mentioned fitting hole having an approximately square shape as viewed in a front view is formed in an approximately center portion of the arcuate wall 33*b* in the arcuate direction. The boss portions 33*a*, 33*a* are formed into an approximately circular columnar shape, and a bolt insertion hole 34 is formed in a center portion of each boss portion 33*a*, 33*a*. As shown in FIG. 2, bolts 35 for fastening and fixing the joint pressing member 30 to the throttle body 2 are inserted into the bolt insertion holes 34.

A first support member 36 having an approximately U shape is contiguously formed with one end side of the arcuate wall 33*b* of the mounting proximal portion 33 in the axial direction, and a second support member 37 having an approximately U shape is contiguously formed on the other end side of the arcuate wall 33*b* in the axial direction. The first support member 36 includes a pair of arm portions 36*a*, 36*a* which extends substantially parallel to each other from a circular arcuate portion 36*b* on a mounting proximal portion 33 side, and the arm portions 36*a*, 36*a* are brought into contact with an end surface of the joint-side engagement flange 24 on a side away from the injector 10. In the same manner, the second support member 37 includes a pair of arm portions 37*a*, 37*a* which extends substantially parallel to each other from a circular arcuate portion 37*b* on a mounting proximal portion 33 side, and the arm portions 37*a*, 37*a* are brought into contact with an end surface (tapered surface 11*a*) of the injector-side engagement flange 11 on a side away from the fuel joint 20. On a contact surface of each arm portion 37*a* which is brought into contact with the injector-side engagement flange 11, a tapered surface 37*c* which is brought into surface contact with the tapered surface 11*a* of the injector-side engagement flange 11 is formed.

Cutout-like gaps which are spaced apart from each other in the axial direction of the fuel joint 20 are formed between the arm portion 36*a* of the first support member 36 and the arm portion 37*a* of the second support member 37. The left and right arm portions 36*a*, 37*a* which are vertically arranged in a spaced-apart manner respectively form pairs in the vertical direction thus forming the clamping portions 32 respectively.

Figure 8:
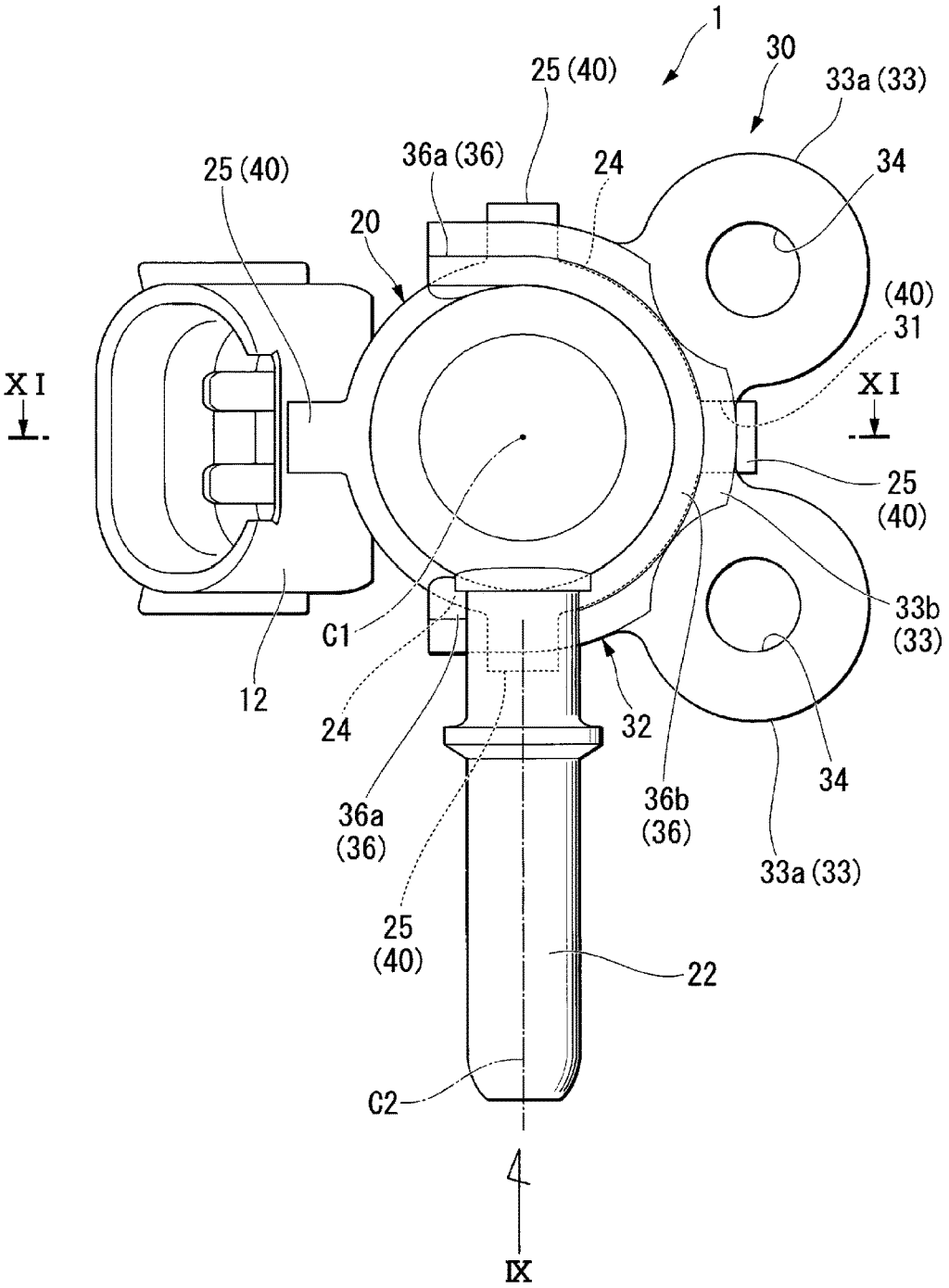
FIG. 8 is a plan view of the injector assembly according to certain embodiments of the invention.
Figure 9:
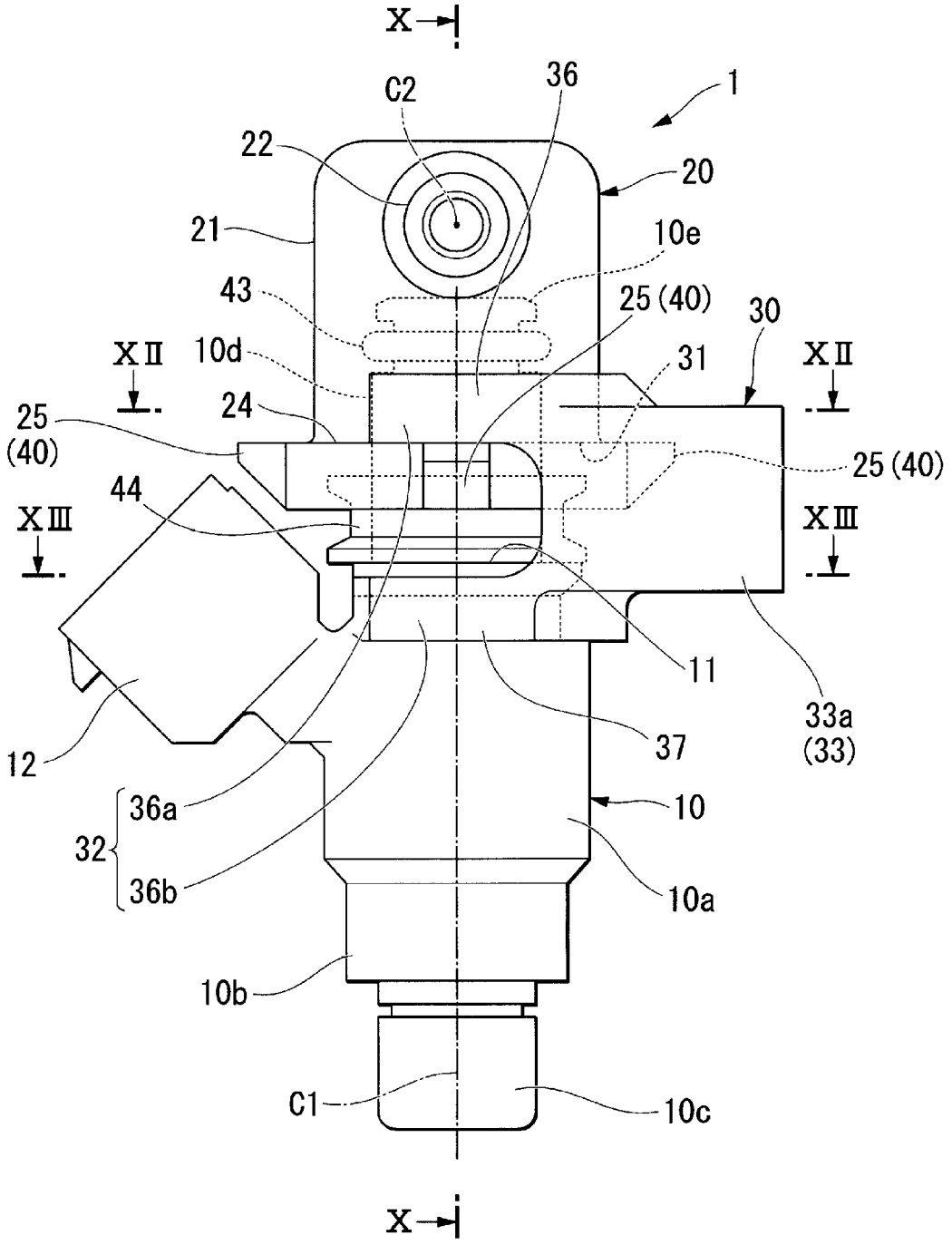
FIG. 9 is a view of the injector assembly according to certain embodiments of the invention as viewed in the direction indicated by an arrow IX in FIG. 8.

FIG. 8 to FIG. 13 are views showing the injector assembly 1 where the fuel joint 20 and the joint pressing member 30 are assembled to the injector 10. FIG. 8 is a plan view of the injector assembly 1, FIG. 9 is a side view of the injector assembly 1, and FIG. 10 to FIG. 13 are cross-sectional views of the injector assembly 1.

Figure 10:
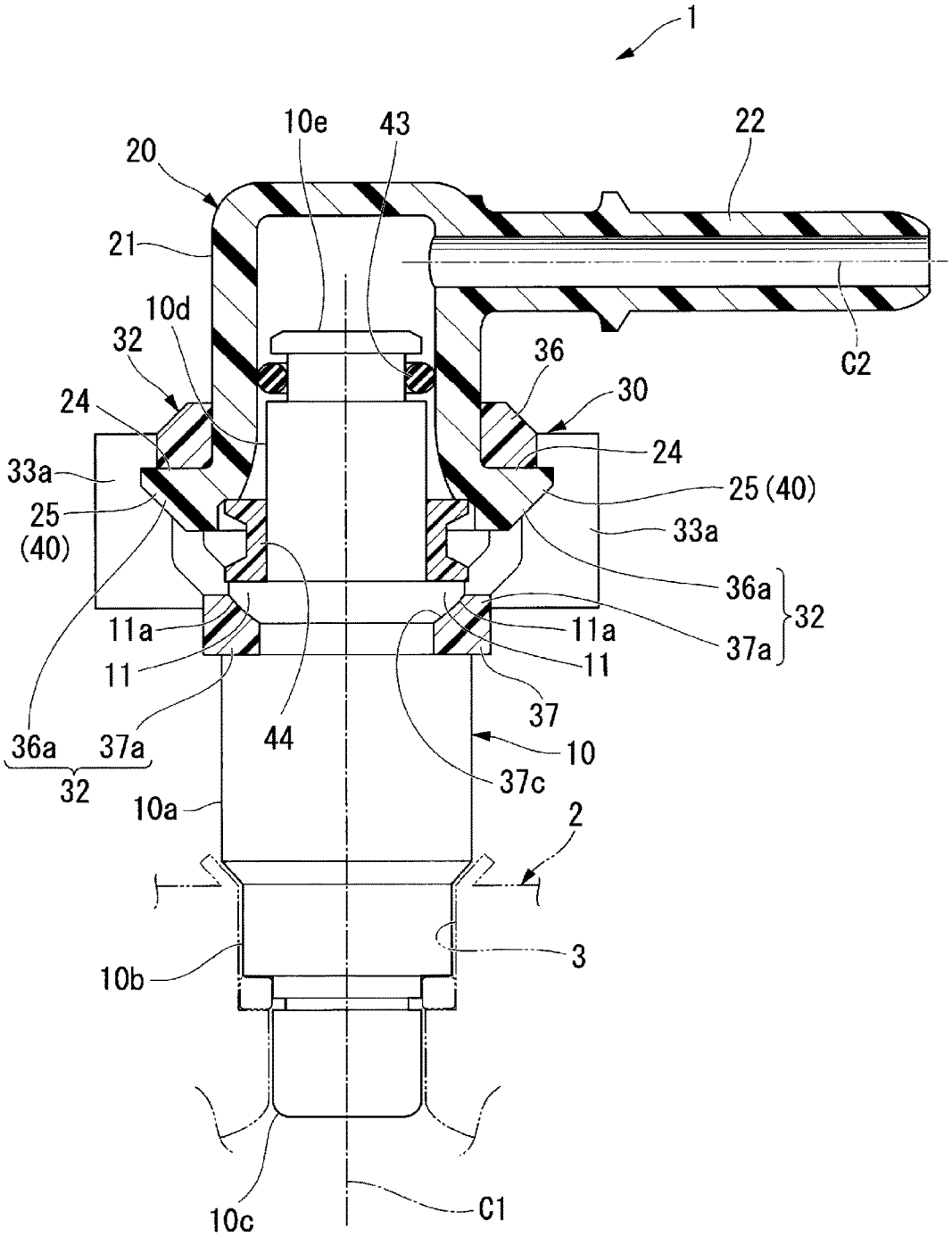
FIG. 10 is a cross-sectional view of the injector assembly according to certain embodiments of the invention taken along a line X-X in FIG. 9.
Figure 11:
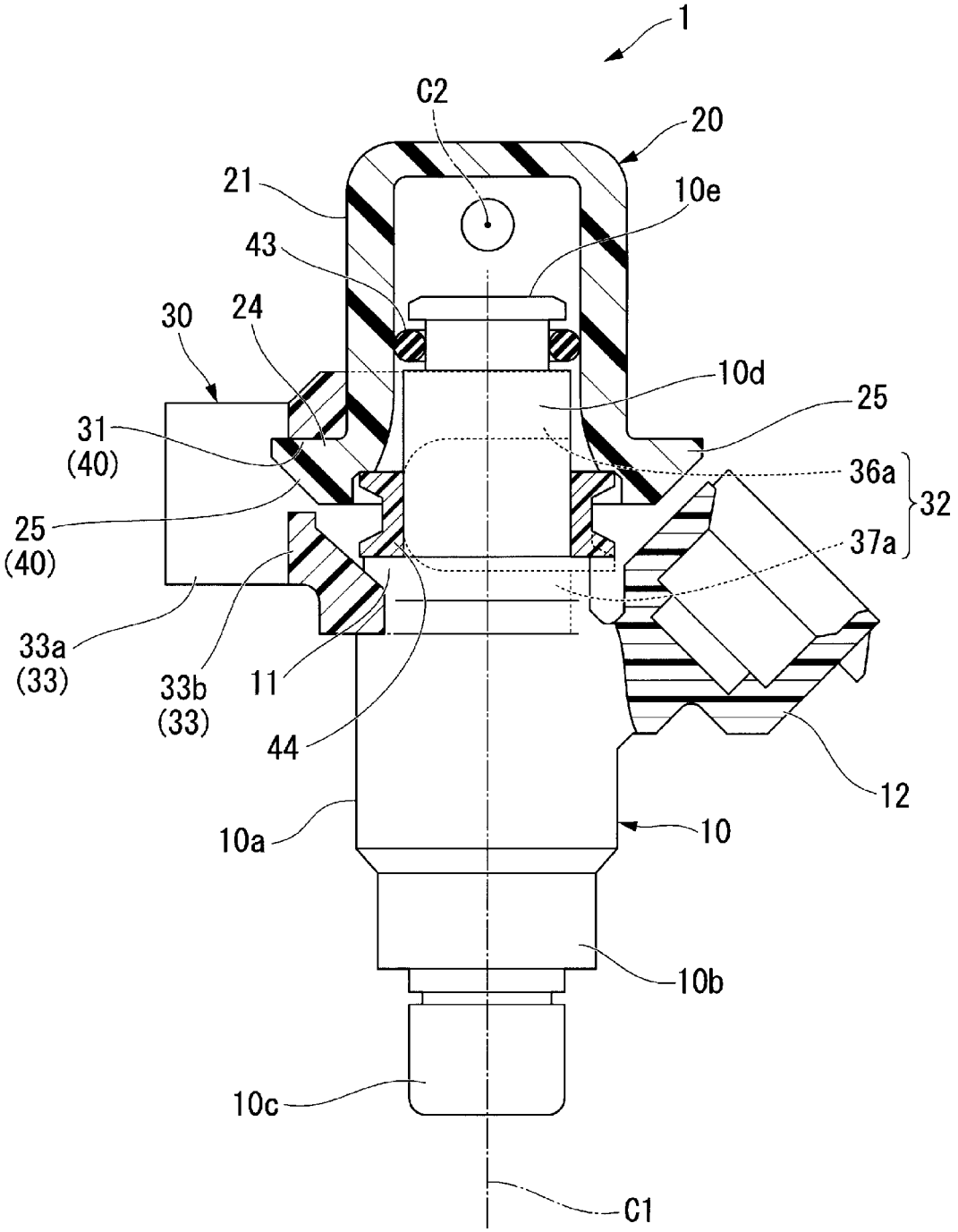
FIG. 11 is a cross-sectional view of the injector assembly according to certain embodiments of the invention taken along a line XI-XI in FIG. 8.
Figure 12:
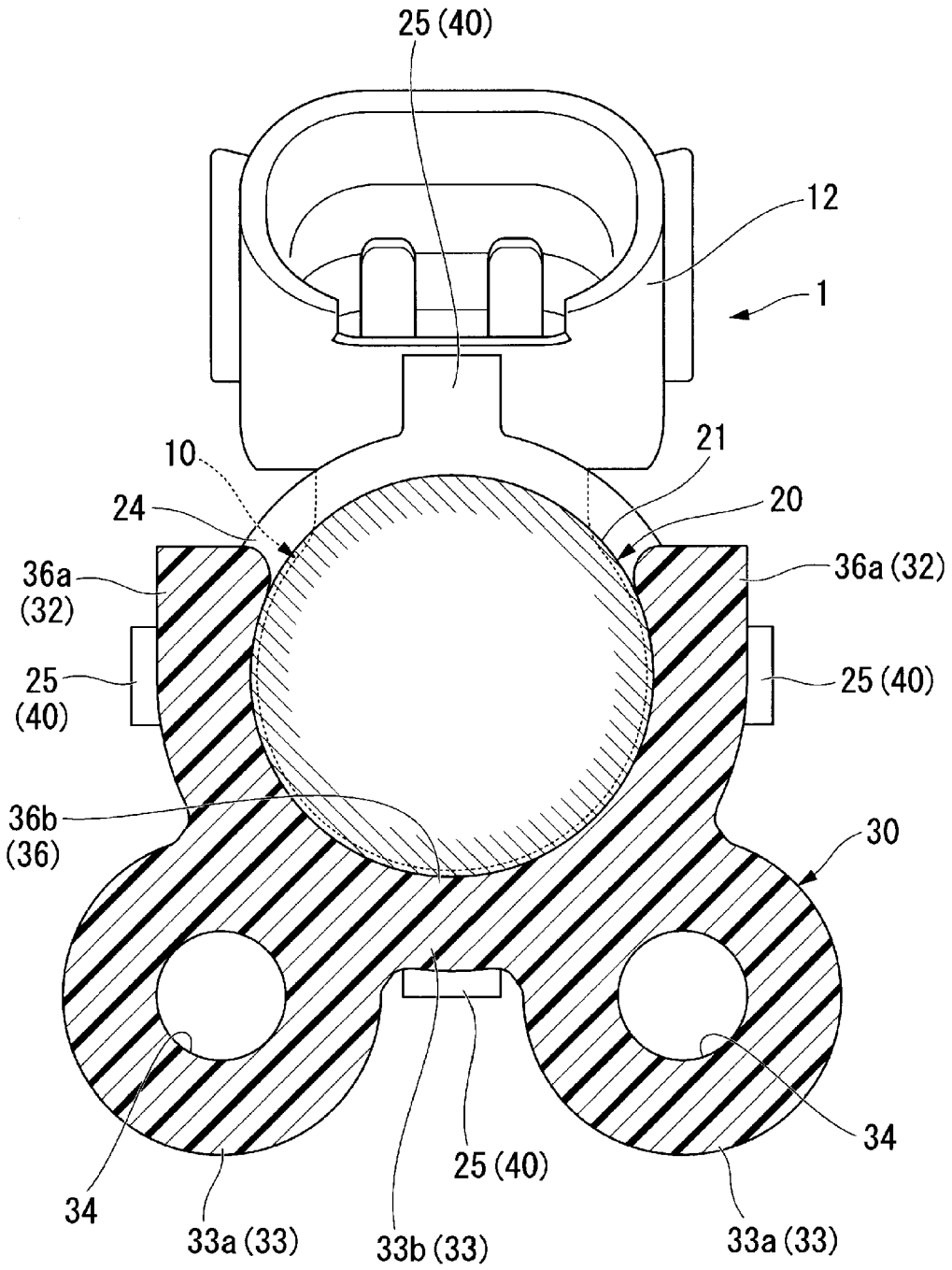
FIG. 12 is a cross-sectional view of the injector assembly according to certain embodiments of the invention taken along a line XII-XII in FIG. 9.
Figure 13:
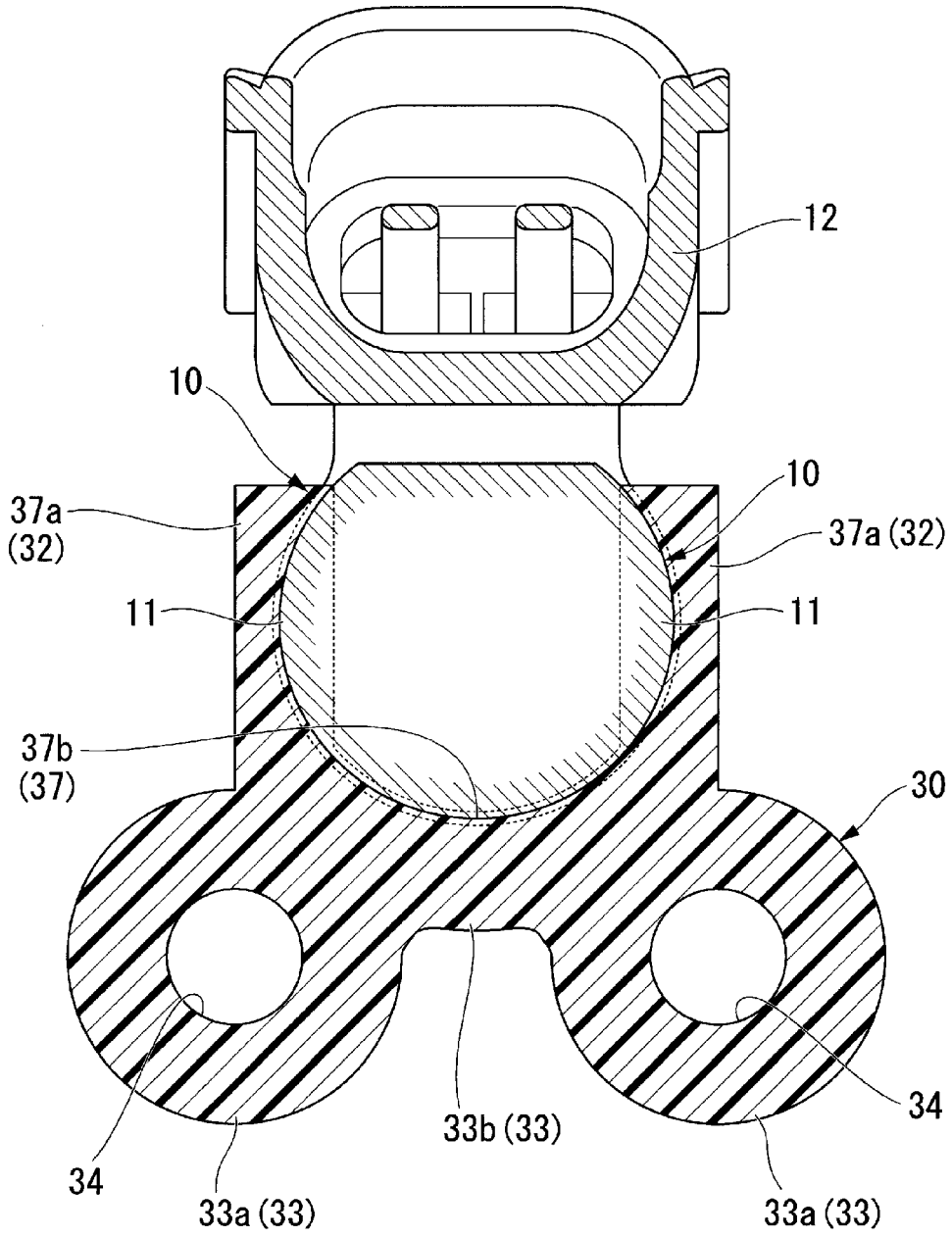
FIG. 13 is a cross-sectional view of the injector assembly according to certain embodiments of the invention taken along a line XIII-XIII in FIG. 9.

The joint body portion 21 of the fuel joint 20 is fitted on the connecting cylindrical portion 10*d* of the injector 10. As shown in FIG. 10 and FIG. 11, a ring-shaped seal member 43 is interposed between the connecting cylindrical portion 10*d* and the joint body portion 21 for liquid-tightly sealing a gap therebetween. In the drawings, symbol 44 indicates a cylindrical dust seal which is interposed between the connecting cylindrical portion 10*d* and the joint body portion 21 so as to prevent the intrusion of dust, mud and the like into a connecting portion between the connecting cylindrical portion 10*d* and the joint body portion 21.

A positioning portion not shown in the drawing is provided between the injector 10 and the fuel joint 20 for positioning a relative angle between the connecting cylindrical portion 10*d* and the joint body portion 21 in the circumferential direction. The fuel joint 20 and the injector 10 are assembled to each other such that the position of the fuel joint 20 at which the connecting pipe portion 22 projects and the connector 12 of the injector are displaced from each other by 90° in the circumferential direction.

The joint pressing member 30 is engaged with the connecting portion between the fuel joint 20 and the injector 10 which are fitted and connected to each other by the clamping portions 32. To be more specific, the left and right arm portions 36*a*, 36*a* of the first support member 36 of the joint pressing member 30 are engaged with the outer peripheral surface of the joint body portion 21 of the fuel joint 20, and the left and right arm portions 37*a*, 37*a* of the second support member 37 are engaged with the proximal-end-side outer peripheral surface of the connecting cylindrical portion 10*d* of the injector 10. At this stage of assembling operation, the left and right arm portions 36*a*, 36*b* of the first support member 36 are brought into contact with an end surface of the joint-side engagement flange 24 on a side away from the injector 10, and the left and right arm portions 37*a*, 37*a* of the second support member 37 are brought into contact with an end surface of the injector-side engagement flange 11 on a side away from the fuel joint 20. Accordingly, the fuel joint 20 and the injector 10 are clamped by the left and right clamping portions 32, 32 of the joint pressing member 30. The left and right arm portions 37*a*, 37*a* of the second support member 37 and the injector-side engagement flange 11 are brought into contact with each other by way of the tapered surfaces 37*c*, 11*a*.

When the left and right clamping portions 32, 32 of the joint pressing member 30 are engaged with the connecting portion between the fuel joint 20 and the injector 10 in this manner, the left and right clamping portions 32, 32 are inserted into the connecting portion between the fuel joint 20 and the injector 10 from the direction opposite to a side of the injector 10 where the connector 12 is arranged. At this stage of the assembling operation, the projections 25 which project in the leftward and rightward directions from the edge of the joint body portion 21 of the fuel joint 20 are inserted into cutout-like gaps each of which is formed between the arm portion 36*a* of the first support member 36 and the arm portion 37*a* of the second support member 37 which are spaced apart from each other in the axial direction.

When the left and right clamping portions 32, 32 are deeply inserted into the connecting portion between the fuel joint 20 and the injector 10, the projection 25 which projects from the edge of the joint body portion 21 toward a mounting portion 33 side of the joint pressing member 30 is inserted into the fitting hole 31 formed in the arcuate wall 33*b* of the mounting proximal portion 33. Due to such a constitution, a relative assembling angle between the joint pressing member 30 and the fuel joint 20 is positioned.

In the example shown in FIG. 1, FIG. 2 and FIG. 8 to FIG. 13, the projection 25 positioned on a left side of the connecting pipe portion 22 as viewed in a top plan view of the fuel joint 20 is inserted into the fitting hole 31. However, the projection 25 which is inserted into the fitting hole 31 is suitably changed corresponding to an assembling angle of the injector 10 and an assembling angle of the fuel joint 20 with respect to the throttle body 2, that is, corresponding to the drawing direction of the fuel hose 23 from the injector 10 for every vehicle to which the injector assembly 1 is applied.

In the injector assembly 1, in this state, the distal end portion (the fitting cylindrical portion 10*b*) of the injector 10 is liquid-tightly fitted into the fitting hole 3 formed in the throttle body 2, and the boss portions 33*a*, 33*a* of the joint pressing member 30 are fastened to the mounting seat 4 of the throttle body 2 by the bolts 35.

As shown in FIG. 1 and FIG. 2, a mating connector 50 which is connected to an electric cable (not shown in the drawing) is fitted and connected to the connector 12 of the injector 10 after the injector assembly 1 is mounted on the throttle body 2. A groove portion 51 having an approximately rectangular cross section is formed on an outer surface of the mating connector 50 along the axial direction. The groove portion 51 has a function that the projection 25 of the fuel joint 20 arranged on the same side where the connector 12 projects when the mating connector 50 is fitted and connected to the connector 12 restricts the position of the mating connector 50 in the rotational direction.

As has been explained previously, in the example the injector assembly 1, the joint pressing member 30 which is a part separate from the fuel joint 20 is provided, and the joint pressing member 30 is fastened to the throttle body 2 using the bolts and hence, the removable of the fuel joint 20 from the throttle body 2 can be restricted by the joint pressing member 30. Accordingly, when the injector assembly 1 is applied to vehicles which differ from each other in a drawing angle the fuel hose 23 from the throttle body 2, the same injector assembly 1 can be easily used in common by those vehicles by changing an assembling angle of the joint pressing member 30 to the fuel joint 20.

That is, when the injector assembly 1 is applied to vehicles which differ in a drawing angle of the fuel hose 23 from the throttle body 2, in assembling the injector assembly 1, an assembling angle of the joint pressing member 30 to the fuel joint 20 is changed such that the connecting pipe portion 22 is directed in the direction which substantially agrees with the drawing direction of the fuel hose 23 and, in such a state, the connecting portion between the fuel joint 20 and the injector 10 is clamped by the clamping portions 32, 32 of the joint pressing member 30. At this stage of the assembling operation, the corresponding projection 25 on a fuel joint 20 side is fitted into the fitting hole 31 formed in the joint pressing member 30. The injector assembly 1 can cope with different drawing angles of the fuel hose 23 by fastening the boss portions 33*a*, 33*a* to the throttle body 2 using bolts without any additional operation.

In the illustrated example of injector assembly 1, the joint-side engagement flange 24 is formed on the fuel joint 20 at a position closer to the injector 10 than the connecting pipe portion 22, and the joint-side engagement flange 24 is pressed in the direction toward the injector 10 by the clamping portions 32, 32 of the joint pressing member 30. Accordingly, the displacement of the fuel joint 20 and the injector 10 can be surely restricted while suppressing a projection amount of the fuel joint 20 in the direction away from the injector 10. Accordingly, in this example of injector assembly 1, the fuel joint 20 can be miniaturized and, at the same time, the joint pressing member 30 can be also miniaturized.

In this example, the plurality of projections 25 are formed on the joint body portion 21 of the fuel joint with angles thereof changed in the circumferential direction, the fitting hole 31 into which any one of the projections 25 formed on a fuel joint 20 side can be selectively fitted is formed in the joint pressing member 30, and the projections 25 and the fitting hole 31 constitute the assembling angle positioning mechanism 40 which can perform the positioning of the fuel joint 20 and the joint pressing member 30 by selectively changing an assembling angle of the fuel joint 20 and the joint pressing member 30. Accordingly, a relative angle of the joint pressing member 30 with respect to the fuel joint 20 can be easily changed by changing the combination of the fitting hole 31 and the projection 25 fitted into the fitting hole 31.

The four projections 25 are formed in this example on a fuel joint 20 side, and one fitting hole 31 into which any one of the projections 25 can be fitted is formed on a joint pressing member 30 side. However, the number of projections 25 formed on a fuel joint 20 side may be arbitrarily set provided that the number of projections 25 is two or more. The number of fitting holes 31 into which the projection 25 can be fitted is not limited to one and may be set arbitrarily.

Further, in certain embodiments, a plurality of projections 25 are formed on a fuel joint 20 side, and at least one fitting hole 31 is formed on a joint pressing member 30 side. To the contrary, a plurality of fitting holes may be formed on a fuel joint 20 side with angles thereof changed in the circumferential direction, and at least one projection which can be fitted into any one of the fitting holes may be formed on a joint pressing member 30 side.

Further, in certain embodiments of injector assembly 1, the joint-side engagement flange 24 is formed on the fuel joint 20, and the injector-side engagement flange 11 is formed on the injector 10, and the clamping portions 32, 32 which are inserted into the connecting portion between the fuel joint 20 and the injector 10 from the side of the connecting portion and clamp the joint-side engagement flange 24 and the injector-side engagement flange 11 are formed on the joint pressing member 30. Accordingly, by merely inserting the clamping portions 32, of the joint pressing member 30 into the connecting portion between the fuel joint 20 and the injector 10 from the side of the connecting portion, the fuel joint 20 and the injector 10 can be easily and surely maintained in a connection state.

Particularly, in certain embodiments of injector assembly 1, the pair of clamping portions 32, 32 are arranged on left and right sides with the connecting portion between the fuel joint 20 and the injector 10 interposed therebetween and hence, the connection state between the fuel joint 20 and the injector 10 can be stably maintained while keeping a balance in the lateral direction.

Further, the connector 12 can be formed on the side of the joint body portion 21 of the injector 10 in a projecting manner, the clamping portions 32 of the joint pressing member 30 are inserted into the connecting portion between the fuel joint 20 and the injector 10 from the direction opposite to a side where the connector 12 is arranged. Accordingly, the clamping portions 32, 32 of the joint pressing member 30 can be easily assembled to the connecting portion between the fuel joint 20 and the injector 10 without interfering with the connector 12.

Figure 14:
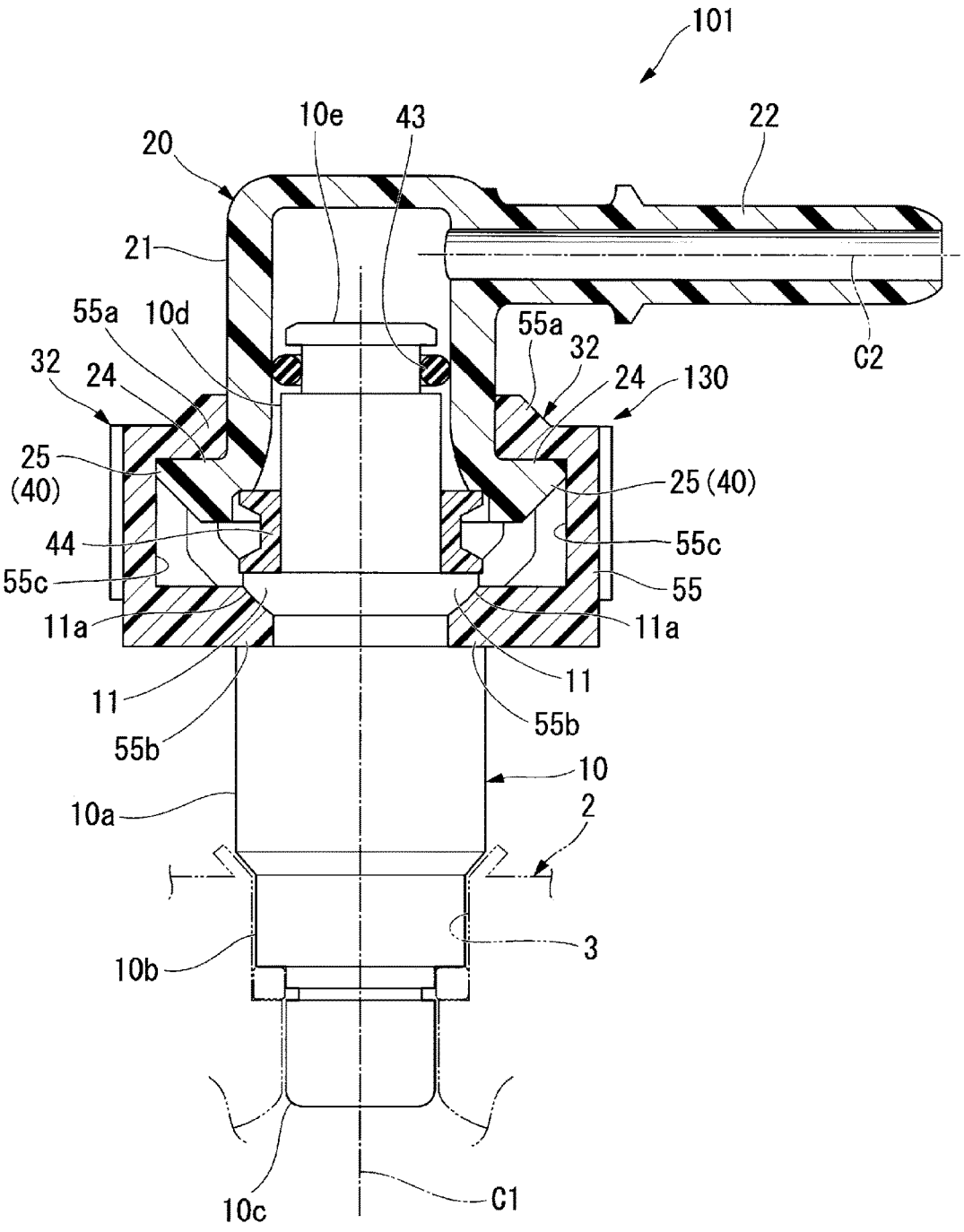
FIG. 14 is a cross-sectional view of an injector assembly according to other embodiments of the invention corresponding to FIG. 10.

FIG. 14 is a view showing an injector assembly 101 according to another embodiment. In FIG. 14, parts identical with the parts of the above-mentioned embodiments are given the same symbols.

In the above-mentioned embodiments, the arm portion 36*a* of the first support member 36 and the arm portion 37*a* of the second support member 37 are formed individually and in a spaced-apart manner on the clamping portions 32, 32 which make the joint-side engagement flange 24 and the injector-side engagement flange 11 engage with each other. In another embodiment shown in FIG. 14, the joint-side engagement flange 24 and the injector-side engagement flange 11 are made to engage with each other using one support member 55 without instead of using two support members spaced apart from each other. A pair of arm portions 55*a*, 55*a* and a pair of arm portions 55*b*, 55*b* can be formed in an extending manner on one end side and the other end side of the support member 55 in the axial direction respectively, and a groove portion 55*c* for preventing the support member 55 from interfering with the projections 25 is formed between the arm portion 55*a* and the arm portion 55*b* spaced apart from each other in the axial direction.

The injector assembly 101 according to other embodiments can basically acquire substantially the same basic advantageous effects as the above-mentioned embodiments. However, in another embodiment, the sides of the connecting portion between the fuel joint 20 and the injector 10 are covered by the support member 55 and hence, another embodiment can acquire an additional advantageous effect that dust and mud minimally enter the connecting portion from the outside.

The invention is not limited to the above-mentioned embodiments, and various design changes are conceivable without departing from the gist of the invention.

DESCRIPTION OF REFERENCE NUMERALS AND SIGNS

1, 101: injector assembly
2: throttle body (mounting member)
10: injector
11: injector-side engagement flange
12: connector
20: fuel joint
22: connecting pipe portion
23: fuel hose
24: joint-side engagement flange
25: projection (one fitting element)
30: joint pressing member
31: fitting hole (the other fitting element)
32: clamping portion
40: assembling angle positioning mechanism

The invention claimed is:

1. An injector assembly, comprising:

an injector including a distal end portion thereof fitted into a mounting member, wherein the injector is configured to supply fuel to an engine;

a fuel joint including a connecting pipe portion to which a fuel hose is connected, and is liquid-tightly connected to a proximal portion of the injector, wherein the injector is fixed to the mounting member in a state where the injector is sandwiched between the fuel joint and the mounting member; and a joint pressing member which is fixed by fastening to the mounting member and which is configured to restrict displacement of the fuel joint in a direction away from the mounting member, wherein the joint pressing member comprises a first support member that includes first left and first right arm portions, the first left and first right arm portions being attached to an outer peripheral surface of the fuel joint, and wherein the joint pressing member comprises a second support member that includes second left and second right arm portions, the second left and second right arm portions being attached to an outer peripheral surface of the injector.

2. The injector assembly according to claim 1, wherein the fuel joint includes a first joint-side engagement flange which is disposed closer to the injector than the connecting pipe portion, displacement of the first joint-side engagement flange in a direction away from the injector being restricted by the joint pressing member.

3. An injector assembly, comprising:

an injector including a distal end portion thereof fitted into a mounting member, wherein the injector is configured to supply fuel to an engine;

a fuel joint including a connecting pipe portion to which a fuel hose is connected, and is liquid-tightly connected to a proximal portion of the injector, wherein the injector is fixed to the mounting member in a state where the injector is sandwiched between the fuel joint and the mounting member;

a joint pressing member which is fixed by fastening to the mounting member and which is configured to restrict displacement of the fuel joint in a direction away from the mounting member; and an assembling angle positioning mechanism configured to selectively change an assembling angle between the fuel joint and the joint pressing member, said assembling angle positioning mechanism being disposed between the fuel joint and the joint pressing member, wherein the assembling angle positioning mechanism includes a first fitting element and a second fitting element which are engageable with each other by male-female fitting engagement, wherein the first fitting element comprises a plurality of fitting elements formed on the fuel joint with angles thereof changed in a circumferential direction, and wherein the second fitting element comprises at least one fitting element disposed on the joint pressing member.

4. An injector assembly, comprising:

an injector including a distal end portion thereof fitted into a mounting member, wherein the injector is configured to supply fuel to an engine;

a fuel joint including a connecting pipe portion to which a fuel hose is connected, and is liquid-tightly connected to a proximal portion of the injector, wherein the injector is fixed to the mounting member in a state where the injector is sandwiched between the fuel joint and the mounting member; and a joint pressing member which is fixed by fastening to the mounting member and which is configured to restrict displacement of the fuel joint in a direction away from the mounting member, wherein the fuel joint includes a first joint-side engagement flange which is disposed closer to the injector than the connecting pipe portion, displacement of the first joint-side engagement flange in a direction away from the injector being restricted by the joint pressing member, wherein the fuel joint includes a second joint-side engagement flange whose displacement in the direction away from the injector is restricted by the joint pressing member, the injector includes an injector-side engagement flange whose displacement in the direction away from the fuel joint is restricted by the joint pressing member, and the joint pressing member includes a clamping portion which, in a state where the fuel joint is connected to a proximal portion of the injector, is inserted into both the fuel joint and the injector from sides of the fuel joint and the injector and clamps the second joint-side engagement flange and the injector-side engagement flange.

5. The injector assembly according to claim 4, wherein the clamping portion is disposed at left and right sides so as to sandwich the fuel joint and the proximal portion of the injector.

6. The injector assembly according to claim 4, further comprising a connector, which is an electric connection portion of a fuel injection portion, disposed on a side of the injector, wherein the clamping portion of the joint pressing member is inserted into the fuel joint and the injector from a direction opposite to a side where the connector is disposed.

7. An injector assembly, comprising:

injector means for injecting fuel into an engine, said injector means including a distal end portion fitted into a mounting member;

fuel joint means for connecting a fuel hose to the injector means, said fuel joint means being liquid-tightly connected to a proximal portion of the injector means, wherein the injector means is fixed to the mounting member such that the injector means is sandwiched between the fuel joint means and the mounting member; and joint pressing means for restricting displacement of the fuel joint means, said joint pressing means being fixed by fastening to the mounting member and for restricting the displacement of the fuel joint means in a direction away from the mounting member, wherein the joint pressing means comprises first support means that includes first left and first right arm portions, the first left and first right arm portions being attached to an outer peripheral surface of the fuel joint means, and wherein the joint pressing means comprises a second support means that includes second left and second right arm portions, the second left and second right arm portions being attached to an outer peripheral surface of the injector means.

8. The injector assembly according to claim 7, wherein the fuel joint means includes first joint-side engagement means disposed closer to the injector means than the connecting pipe portion, displacement of the first joint-side engagement means in a direction away from the injector means being restricted by the joint pressing means.

9. An injector assembly, comprising:

injector means for injecting fuel into an engine, said injector means including a distal end portion fitted into a mounting member;

fuel joint means for connecting a fuel hose to the injector means, said fuel joint means being liquid-tightly connected to a proximal portion of the injector means, wherein the injector means is fixed to the mounting member such that the injector means is sandwiched between the fuel joint means and the mounting member;

joint pressing means for restricting displacement of the fuel joint means, said joint pressing means being fixed by fastening to the mounting member and for restricting the displacement of the fuel joint means in a direction away from the mounting member; and assembling angle positioning means for selectively changing an assembly angle between the fuel joint means and the joint pressing means, said assembly angle positioning means being disposed between the fuel joint means and the joint pressing means, wherein the assembling angle positioning means includes a first fitting means and a second fitting means which are engageable with each other by a male-female fitting engagement, wherein the first fitting means comprises a plurality of fitting elements formed on the fuel joint means with angles thereof changed in a circumferential direction, and wherein the second fitting means comprises at least one fitting element disposed on the joint pressing means.

10. An injector assembly, comprising:

injector means for injecting fuel into an engine, said injector means including a distal end portion fitted into a mounting member;

fuel joint means for connecting a fuel hose to the injector means, said fuel joint means being liquid-tightly connected to a proximal portion of the injector means, wherein the injector means is fixed to the mounting member such that the injector means is sandwiched between the fuel joint means and the mounting member; and joint pressing means for restricting displacement of the fuel joint means, said joint pressing means being fixed by fastening to the mounting member and for restricting the displacement of the fuel joint means in a direction away from the mounting member, wherein the fuel joint means includes first joint-side engagement means disposed closer to the injector means than the connecting pipe portion, displacement of the first joint-side engagement means in a direction away from the injector means being restricted by the joint pressing means, wherein the fuel joint includes a second joint-side engagement means whose displacement in the direction away from the injector means is restricted by the joint pressing means, wherein the injector means includes an injector-side engagement means whose displacement in the direction away from the fuel joint means is restricted by the joint pressing means, and wherein the joint pressing means includes a clamping means which, in a state where the fuel joint means is connected to a proximal portion of the injector means, is inserted into both the fuel joint means and the injector means from sides of the fuel joint means and the injector means and clamps the second joint-side engagement means and the injector-side engagement means.

11. The injector assembly according to claim 10, wherein the clamping means is disposed at left and right sides so as to sandwich the fuel joint means and the proximal portion of the injector means.

12. The injector assembly according to claim 10, further comprising connector means disposed on a side of the injector means, wherein the clamping means of the joint pressing means is inserted into the fuel joint means and the injector means from a direction opposite to a side where the connector means is disposed.

13. The injector assembly according to claim 12, wherein the connector means comprises an electric connection portion of a fuel injection portion.

* * * * *